US005365244A

United States Patent [19]

Yon et al.

[11] Patent Number: 5,365,244

[45] Date of Patent: Nov. 15, 1994

[54] WIDEBAND NOTCH RADIATOR

[75] Inventors: James B. Yon, Upper Marlboro; Timothy G. Waterman, Eldersburg, both of Md.

[73] Assignee: Westinghouse Electric Corporation, Pittsburgh, Pa.

[21] Appl. No.: 10,716

[22] Filed: Jan. 29, 1993

[51] Int. Cl.[5] ..... H01Q 13/10

[52] U.S. Cl. ..... 343/767; 343/862

[58] Field of Search ..... 343/767, 700 MS File, 343/772, 789, 862; H01Q 1/38, 13/10

[56] References Cited

U.S. PATENT DOCUMENTS

| | | | |
|---|---|---|---|
| 2,629,051 | 2/1953 | Lindenblad | 343/767 |
| 2,658,145 | 11/1953 | Dorne et al. | 343/767 |
| 3,056,130 | 9/1962 | Charman | 343/767 |
| 3,541,557 | 11/1970 | Miley | 343/767 |
| 3,771,157 | 11/1973 | Stang | 343/708 |
| 4,431,999 | 2/1984 | Gutleber | 342/367 |
| 4,500,887 | 2/1985 | Nester | 343/700 MS |
| 4,723,305 | 2/1988 | Phillips et al. | 343/702 |
| 4,843,403 | 6/1989 | Lalezari et al. | 343/767 |
| 4,853,704 | 8/1989 | Diaz et al. | 343/767 |
| 5,081,466 | 1/1992 | Bitter, Jr. | 343/767 |
| 5,233,360 | 8/1993 | Kuroda et al. | 343/700 MS |

*Primary Examiner*—Michael C. Wimer

[57] ABSTRACT

An antenna element for radiating electromagnetic signals having a first and a second generally C-shaped groundplane that are formed of conductive material. The groundplanes are connected to one another and define a notch which has one end that is open to free space. An elongated section of transmission line is disposed between the two groundplanes. The transmission line has a source receiving end connectable to a signal source and also has a feed end opposite to the source receiving end. A segment which acts as a transformer is located within the notch. The transformer segment has a first end that is connectable to the feed end of the transmission line and has a second end which faces the notch open end.

Preferably, at least one transformer step is located along the transmission line between the source receiving end and the feed end. Also, an open circuit section of transmission line is preferably connected to the transformer segment second end.

7 Claims, 1 Drawing Sheet

WIDEBAND NOTCH RADIATOR

BACKGROUND OF THE INVENTION

1. Field of the Invention

This invention relates to antenna structures and more particularly to a compact wideband notched radiating element for incorporation into a planar array antenna.

2. Description of the Prior Art

Open ended slot or notched radiating elements are known in the art. Such notched radiating elements are advantageous because they have a relatively wide bandwidth. Notch radiators have other important advantages which are desirable, such as being light in weight and able to be inexpensively manufactured with printed circuit board techniques that are capable of accurate replication from unit to unit.

Often, notch radiating elements are used in wide scanning planar array antennas. Within the array, each notched radiating element is spaced an equal distance apart, with that distance being roughly a half wavelength at the highest operating frequency. This spacing ensures that there is no occurrence of grating lopes that rob the antenna of gain and directionality. Because of this near "square" aperture that each element sees in free space, it becomes necessary to transform typically low impedances (30 to 100 ohms) in microwave power dividers to the quite high impedances (200 to 400 ohms) of near square apertures. Compounding this transform problem are the requirements to make radiating elements less deep and have multiple octave bandwidths.

The bandwidth of a notch radiator is a function of the impedance step and the geometry of the notch. Previously, to get a truly broadband radiating element, one that operates over a wide frequency band, the notched element must be made relatively deep, one to one and a half wavelengths deep, because the impedance ratio between each radiating element feed and free space can be high—nearly 10:1. Therefore, an impedance transformer is needed to lower the impedance of the radiating element.

One way in which the transformer can be incorporated into the radiating element is by using transformers in the form of notches, which is done by making the notch deeper. The transformer may also be accomplished by placing transformer steps on the transmission line feeding the radiating element. The drawback to this approach is that the transformer steps take up a relatively large amount of room in a crowded array environment and we find that the last stage of the transformer to be greater than 200 ohms (for multiple step) and is usually not achievable inside of a microwave package.

Under either transformer approach, the radiating element must be designed to have a large depth so that it may accommodate either the depth of the notch needed for the notch transformer or the transformer steps of the transmission line. The restrictions in the amount of room available in a planar array often limit the possible depth of the radiating element which in turn limits the bandwidth of the antenna.

SUMMARY OF THE INVENTION

We provide a notched antenna element for radiating electromagnetic signals. The present notched antenna element has first and second generally C-shaped groundplanes that are fabricated of conductive material. The groundplanes are connected to one another in a parallel and spaced apart manner thus defining the structure of the element. The element has a front which has a narrow opening. The opening opens into a notch between the front and rear of the element. The opening on the front side of the element is open to free space. The two groundplanes are connected by several conductive groundplanes located at the front side of the element and around the periphery of the notch.

An elongated section of transmission line is disposed between the two groundplanes. The transmission line has a source receiving end connectable to a signal source and also has a feed end opposite to the source receiving end. A segment which acts as a transformer is located within the notch and is connected to the feed end of the transmission line. The transformer segment has a first end that is connectable to the feed end of the transmission line and has a second end which faces toward the notch opening.

Preferably, at least one transformer step is located along the transmission line between the source receiving end and the feed end. Also, an open circuit section of transmission line is preferably connected to the transformer segment second end.

Thus, the proposed solution involves transforming almost entirely in the stripline by altering the width of the stripline but saving the last (high impedance) section for the balun notch region. The reasons are two fold: (1) the balun is a naturally high impedance having only one half of the field lines of a stripline conductor, and (2) the groundplane spacing tends to be large in this region minimizing the reactive effects across the band induced by the short circuit element of the balun. The shallow depth is achievable by placing the last stripline transformer step inside the high impedance short circuit. The short circuit acts as part of the balun for wideband performance as well as the groundplane for the last transformer section enabling transforming from a 50 ohm speed to free space.

Other details, objects and advantages of the invention will become apparent as the following description of certain present preferred embodiments thereof proceeds.

DETAILED DESCRIPTION OF THE PREFERRED EMBODIMENT

In a planar array antenna, the radiating elements are arranged in a rectangular or square structure with each element being spaced an equal distance apart. The antenna operates over a selected bandwidth with the radiating elements preferably spaced about a half wavelength apart at the highest frequency of the bandwidth.

Figure 1:
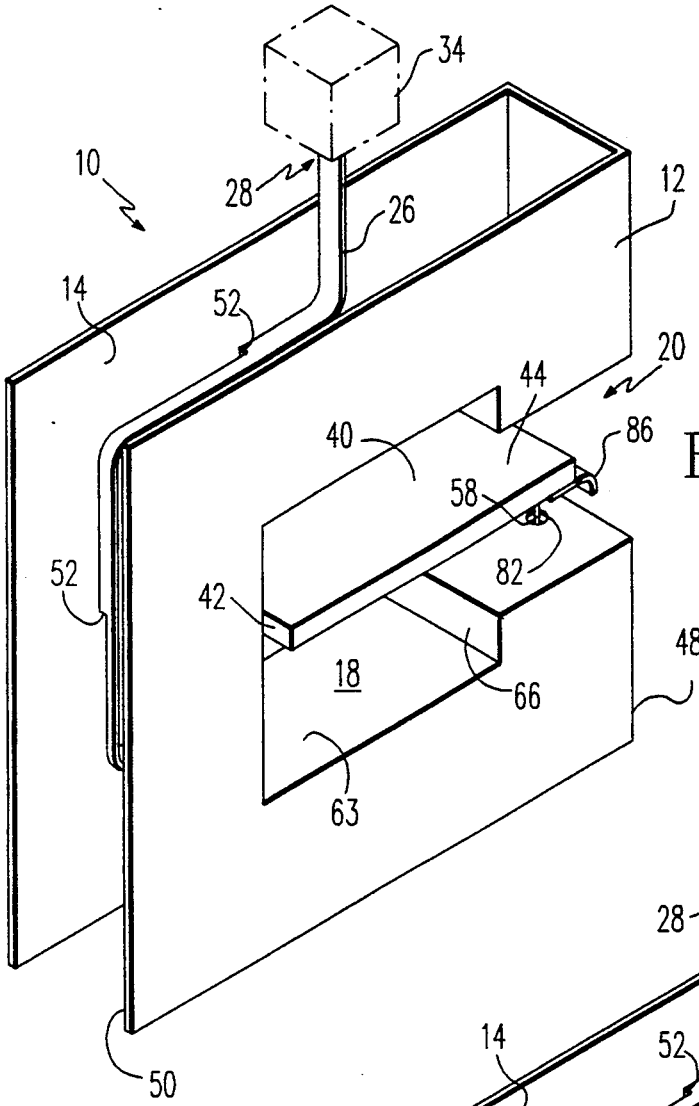
FIG. 1 is a perspective view of a preferred embodiment of the notch radiator.
Figure 2:
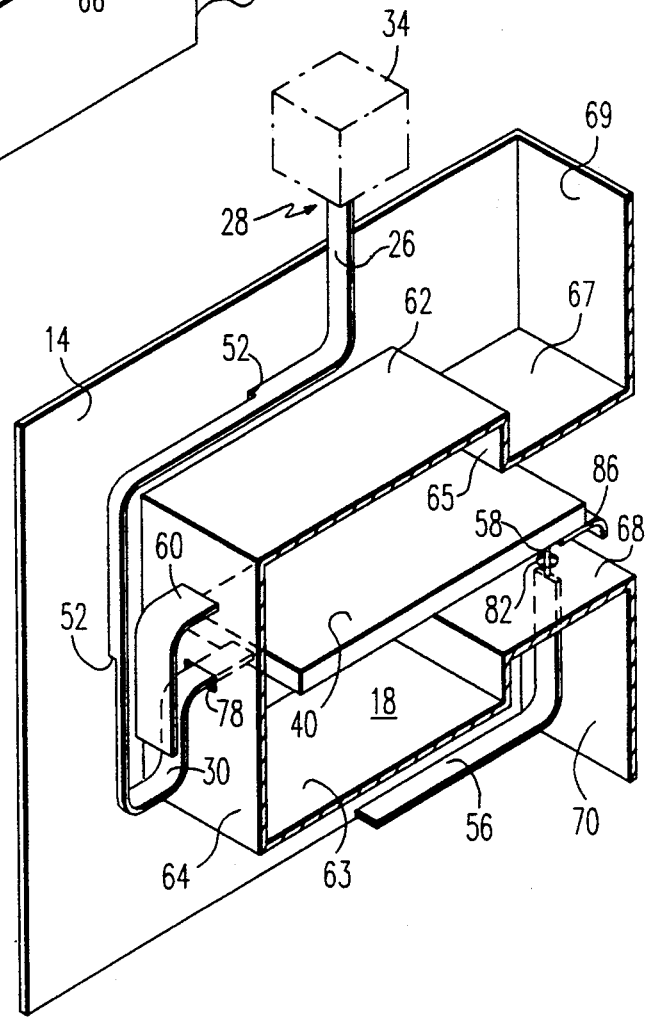
FIG. 2 is a view of the preferred notch radiator, similar to FIG. 1 that has the second groundplane removed to show its circuitry.

Referring to FIGS. 1 and 2, a preferred notched radiating element 10 is shown which is comprised of two generally C-shaped groundplanes 12 and 14. The element 10 has a front side 48 and a rear side 50. The groundplanes 12 and 14 are oriented parallel to one another and spaced apart at a selected distance, forming the structure of the element 10. Being C-shaped, each groundplane 12 and 14 has an opening 20 formed on a respective side that opens into a cavity or notch 18. The groundplanes 12 and 14 are oriented so that the notched front side of both groundplanes 12 and 14 are directed in the same direction, which is the front 48 of the structure 10.

Several transverse connecting planes 62 through 70 connect the first groundplane 12 to the second groundplane 14. The connecting planes connect the two groundplanes 12, 14 at the corresponding locations of each groundplane 12, 14 surrounding and defining the notch cavity 18. At the front side 48 of the element 10, an upper side connecting plane 69 and a lower side connecting plane 70 connect the two groundplanes above and below the notch opening 20, respectively. An upper notch opening connecting plane 67 and a lower notch opening connecting plane 68 define the notch opening, connecting the two groundplanes 12, 14 and being connected to the upper side connecting plane 69 and the lower side connecting plane 70, respectively. A notch rear connecting plane 64 connects the two groundplanes 12, 14 at the end of the notch cavity 18 farthest from the notch opening 20. The two groundplanes are connected by connecting planes 62, 63, 65, 66 along the remaining periphery of the notch cavity 18. The relative dimensions of the notch cavity 18 are not crucial, however, it is preferred that the rear of the notch cavity defined by notch rear connecting plane 64 be as long as possible so that the highest possible short circuit impedance be created in the balun.

The first and second groundplanes 12, 14 as well as the connecting planes are each made of a conductive material. Although any conductive material may be used, some materials which are particularly well suited for this application are aluminum, copper, gold and silver.

The stripline transmission line circuitry 26 is essentially a conductive strip of material disposed between the two groundplanes 12, 14. The stripline transmission line 26 is disposed within the radiating element 10 on a plane parallel to and halfway between the two groundplanes 12, 14. The stripline transmission line 26 is supported between the two groundplanes 12, 14 away from each of the groundplanes 12, 14 by any convenient and well known means that will not disturb the signal traveling along the stripline transmission line 26, such as by a plurality of Teflon TM beads.

In the typical frequency in which the notch radiating element 10 is employed, such as the L band or S band, the radiating elements 10 are approximately three inches tall, one half inch wide and about three inches deep. Therefore, the groundplanes 12, 14 are preferably spaced about a half inch apart.

The stripline transmission line 26 has two ends, a source receive end 28 and a feed end 30 that is opposite to the source receive end 28. The source receive end 28 is connected to a signal source 34 represented by the dotted line of FIG. 2. The feed end 20 of the transmission line 26 passes through an opening 78 in the notch rear connecting plane 64 and is connected to a transformer segment 40. The source receive end 28 of the transmission line 26 may pass between the two groundplanes so that the transmission line 26 may be connected with the signal source 34 at a location outside of the radiating element and not obstructing the radiating field.

Several transformer steps 52 are placed along the stripline transmission line 26 between the source receive end 28 and the feed end 30. The transformation is achieved by altering the distance of the stripline transmission line 26 to the groundplanes 12, 14. Preferably, the groundplane spacing is kept constant while the width of the stripline is changed to effectuate the distance change between the stripline transmission line 26 and the groundplanes 12, 14.

To gain sufficient length for the transformation steps, the stripline transmission line 26 is preferably placed along the longest dimension of the radiating element 10, which in the preferred embodiment is between the front 48 and rear 50 of the element 10 above the notch cavity 18. Before reaching the rear 50 of the element, the transmission line 26 changes direction and travels downward between the notch cavity and the rear 50 of the element 10. The transmission line 26 then turns and travels in the direction of the front 48 of the element 10 stopping short of the notch rear connecting plane 64 where the transmission line 26 turns upward. The transmission line 26 continues upward until it is adjacent to the transformer segment 40 where the transmission line 26 turns and is connected to the transformer segment 40.

Because the transmission line 26 must be turned at several locations, it may happen that portions of the stripline 26 may be so close to one another as a function of frequency such that coupling will occur. This coupling can be prevented by extending a short circuit conducting wall 60 that is connected to ground, between the adjacent portions of stripline 26. The short circuit wall 60 is connected to both groundplanes 12, 14.

The transformer segment 40 is essentially a thick bar of metal having a first end 42 and a second end 44. The first end 42 of the transformer segment 40 is connected to the feed end 30 of the transmission line 26. The second end 44 of the transformer segment 40 is directed so as to face the notch opening 20 in the front side 48 of the element 10. The transformer segment 40 transforms from the lower impedance stripline transmission line 26 to a value approaching the impedance of free space, which is approximately 377 ohms.

The value of the impedance at any point in the radiating element is equal to the square root of the inductance over the capacitance.

$$\sqrt{L/C}$$

Thus, being between the groundplanes 12, 14, the stripline transmission line 26 has electrical field lines with voltage running to both groundplanes 12, 14 and therefore has a capacitance. And due to the relationship between capacitance and impedance, the transmission line 26 also has an impedance that is measureable by determining the distance of the stripline transmission line 26 to the two groundplanes 12, 14. Once the signal travels from the feed end 30 of the transmission line 26 to the first end 42 of the transformer segment 40 in the notch 18, the signal is no longer directly between the groundplanes 12, 14 and the capacitance drops substantially. There will be capacitance between the transformer segment 40 and connecting groundplanes 62 and 63. However, this capacitance is much less than the capacitance of the stripline since the connecting plates 62, 63 are at a greater distance from the transformer segment 40 than the transmission line 26 is to the groundplanes 12, 14. As the value of the capacitance drops, the impedance increases, so that the impedance at the transformer segment 40 approaches the impedance of free space.

In operation, the signal source 34 provides a signal, which is preferably an industry standard 50 ohm signal, to the element 10 at the source receive end 28 of the transmission line 26. The signal travels over transformation steps 52 where the impedance is raised. The signal then travels to the feed end 30 of the transmission line where it enters the transformer segment 40.

A wire 58 connects the second end 44 of the transformer segment 40 to an open circuit segment 56 of stripline transmission line between the groundplanes 12, 14. The wire 58 may either be connected directly to the second end 44 of the transformer segment 40 or be connected to a flap 86 that is part of the second end 44 of the transformer segment 40. The flap 86 performs the function of adding capacity at the drive point to counteract the inductance of a thin drive point. The wire 58 travels to the open circuit 56 through an opening 82 in the notch lower mouth connecting plane 68. The open circuit 56 has an electrical length that is approximately a quarter wavelength of the nominal operating frequency of the antenna.

When the signal travels from the stripline 26 between the groundplanes, which is an unbalanced mode, to free space which is balanced, a backward radiating wave could be generated. The open circuit 56 at the end of the signal path causes the reactants of the open circuit 56 to cancel the reactants of the notch 18 which increases the bandwidth at the notch 18. When the signal travels to the transformer segment second end 44, a portion of the signal travels out of the notch opening 20, a portion of the signal travels backward toward the first end 42 of the transformer segment 40, and a portion of the signal continues down the signal path toward the open circuit 56. The portion of the signal traveling towards the first end 42 of the transformer segment 40 reflects off the notch connection 64 at the rear of the notch 18 and comes forward again. The depth of the notch 18 ensures that the portion of the signal reflecting off the back of the notch 18 adds in phase with the portion of the signal that is transmitted out of the notch opening 20. The open circuit 56, having a nominal quarter wavelength electrical length, causes the signal that was reflected from the end of the open circuit 56 to add out of phase with the portion of the signal bouncing off the balun and leaving the radiating element 10. This helps cancel the reactance of the notch.

The connecting planes, which are attached to each of the groundplanes at the front of the element and bordering the notch cavity, prevent the electrical fields generated and the stripline from entering the notch or from interfering with the signal leaving the front of the element.

Although the transmission line has been shown traveling above the notch cavity 18, while the open circuit 56 is shown as being below the notch cavity 18, the transmission line may also be extended below the notch cavity 18 and the open circuit 56 placed above the notch cavity 18.

While a present preferred embodiment of the invention has been shown, it is distinctly understood that the invention is not limited thereto but may be otherwise variously embodied within the scope of the following claims.

We claim:

1. An antenna element for radiating electromagnetic signals, comprising:

a first groundplane and a second groundplane that are formed of conductive material, the groundplanes being parallel and spaced apart from one another, one side of the groundplanes defining a front of the element, each groundplane being generally C-shaped and being similarly oriented, the groundplanes further having a plurality of connecting planes attached to and connecting the groundplanes such that a notch is formed thereby at the front of the element that opens to free space;

an elongated section of transmission line disposed between the two groundplanes, the transmission line having a source-receiving end connected to a signal source and having a feed end opposite to the source-receiving end; and a transformer segment located within the notch, the transformer segment having a first end and an oppositely located second end, the transformer segment first end being connected to the feed end of the transmission line, the transformer segment second end facing the notch opening.

2. The antenna element of claim 1 further comprising at least one transformer step located along the transmission line between the source-receiving end and the feed end.

3. The antenna element of claim 1 further comprising an open circuit section of transmission line connected to the transformer segment second end.

4. The antenna element of claim 1 further comprising a short circuit wall connected to the first and second groundplanes, the short circuit wall located adjacent the transmission line between the source-receiving end and the feed end.

5. The antenna element of claim 1 wherein the transmission line is stripline circuitry.

6. The antenna element of claim 1 further comprising connecting planes attached to and connecting the groundplanes along the front of the element on opposite sides of the notch.

7. An antenna element for radiating electromagnetic signals, comprising:

a first groundplane and a second groundplane that are formed of conductive material, the groundplanes being parallel and spaced apart from one another, one side of the groundplanes defining a front of the element, each groundplane being generally C-shaped and being similarly oriented, the groundplanes further having a plurality of connecting planes attached to and connecting the groundplanes such that a notch is formed thereby at the front of the element that opens to free space;

an elongated section of transmission line disposed between the two groundplanes, the transmission line having a source-receiving end connected to a signal source and having a feed end opposite to the source-receiving end;

a short circuit wall connected to the first and second groundplanes, the short circuit wall located adjacent the transmission line between the source-receiving end and the feed end;

at least one transformer step located along the transmission line between the source-receiving end and the feed end;

a transformer segment located within the notch, the transformer segment having a first end and an oppositely located second end, the transformer segment first end being connected to the feed end of the transmission line, the transformer segment second end facing the notch opening; and an open circuit section of stripline connected to the transformer segment second end.

* * * * *